United States Patent [19]

Cap et al.

[11] 4,161,672

[45] Jul. 17, 1979

[54] HIGH PRESSURE METAL VAPOR DISCHARGE LAMPS OF IMPROVED EFFICACY

[75] Inventors: Daniel M. Cap, Kirtland; William H. Lake, Novelty, both of Ohio

[73] Assignee: General Electric Company, Schenectady, N.Y.

[21] Appl. No.: 912,628

[22] Filed: Jun. 5, 1978

Related U.S. Application Data

[63] Continuation-in-part of Ser. No. 812,479, Jul. 5, 1977, abandoned.

[51] Int. Cl.[2] ..... H01J 61/30

[52] U.S. Cl. ..... 313/220; 313/184; 313/214; 313/229

[58] Field of Search ..... 313/184, 225, 227, 229, 313/220, 216

[56] References Cited

U.S. PATENT DOCUMENTS

| | | | |
|---|---|---|---|
| 2,272,467 | 2/1942 | Kern et al. | 176/122 |
| 2,545,884 | 3/1951 | Isaacs et al. | 176/122 |
| 3,259,777 | 11/1945 | Fridrich | 313/184 |
| 3,379,868 | 4/1968 | Taillon | 240/11.4 |
| 3,654,506 | 4/1972 | Kuhl et al. | 313/184 |
| 3,896,326 | 7/1975 | Fohl | 313/220 |
| 3,897,594 | 7/1975 | Popp et al. | 313/214 |
| 3,937,996 | 2/1976 | Cap | 313/217 |

FOREIGN PATENT DOCUMENTS 38-2640 2/1963 Japan.

*Primary Examiner*—Robert Segal
*Assistant Examiner*—Darwin R. Hostetter
*Attorney, Agent, or Firm*—Ernest W. Legree; Lawrence R. Kempton; Frank L. Neuhauser

[57] ABSTRACT

High pressure discharge lamps containing a fill of mercury and metal halides, having a power input of 250 watts or below and useable for general illuminating purposes achieve higher efficacy by developing high end temperatures without excessively obstructing the transmission of light and without creating excessive thermal losses through radiation and conduction. To reduce the obstruction of light, heat-conserving coatings on the lamp ends are preferably omitted and small neck seals are used which serve also to reduce thermal losses. The lamps are constructed with an aspect ratio of arc chamber length to diameter from 0.9 to 2.5 and with an electrode insertion factor from 0.1 to 0.6 and operate with a wall loading from 10 to 35 watts/cm$^2$ and with an arc loading from 60 to 150 watts/cm.

6 Claims, 7 Drawing Figures

Fig. 2
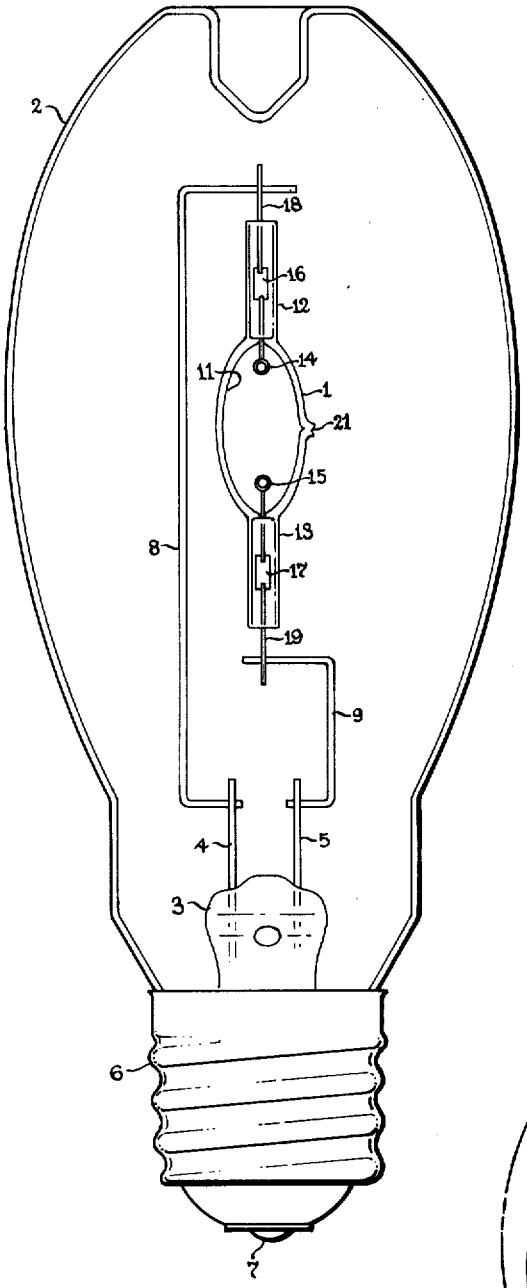
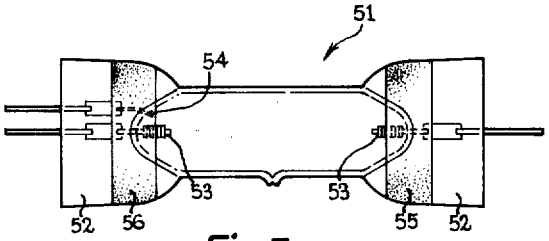
Fig. 3
(PRIOR ART)
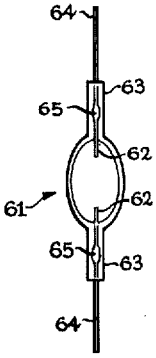
Fig. 4
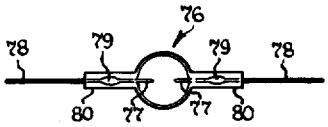
Fig. 5
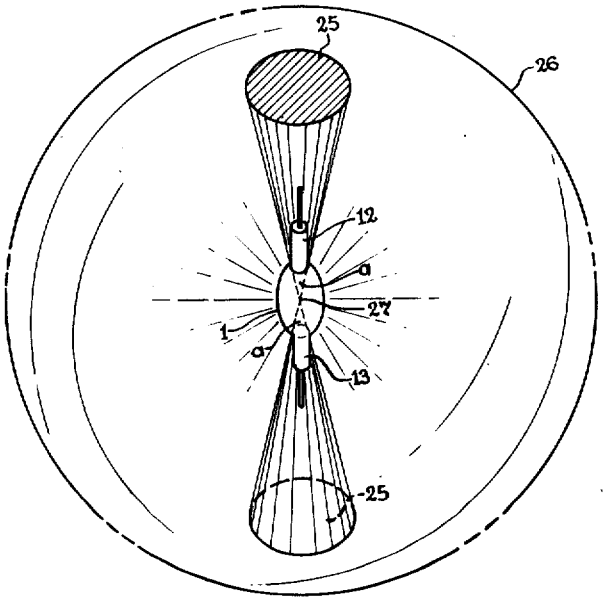
Fig. 6

HIGH PRESSURE METAL VAPOR DISCHARGE LAMPS OF IMPROVED EFFICACY

CROSS-REFERENCE TO A RELATED APPLICATION

This application is a continuation-in-part of our application Ser. No. 812,479, filed July 5, 1977, now abandoned.

The invention relates to high pressure metal vapor discharge lamps containing a fill of mercury and selected metal halides and is particularly concerned with achieving high efficacy in lamps of 250 watts or less and capable of being used for general illuminating purposes.

BACKGROUND OF THE INVENTION

The high pressure discharge lamps of the invention operate by vaporizing mercury and selected metal halides and often are simply called metal halide lamps even though the fill of the lamp contains mercury as well as one or more metal halides. High wattage metal halide lamps which achieve relatively high efficacy are known in the art. For example, Fohl U.S. Pat. No. 3,896,326 discloses 1,000 watt metal halide lamps which are said to have an average initial efficacy of 119 lumens per watt. Kuhl et al U.S. Pat. No. 3,654,506 discloses a 500 watt metal halide lamp stated to operate with an efficacy of 90 lumens per watt.

These high wattage lamps, however, are too large for general illuminating purposes in a home or the like. Intermediate wattage metal halide lamps which can be used for some general illuminating purposes are known but their efficacy is low when compared with lamps of large sizes. By way of example, Japanese Publication No. Sho 46/1971-21433 (published June 17, 1971) discloses 250 watt metal halide lamps which achieve efficacies in the range of only 60 to 70 lumens per watt. The assignee of the present invention has previously developed a 250 watt metal halide lamp having an efficacy of 82 lumens per watt. The smallest size of metal halide lamp which has been placed in commercial use for general lighting purposes is 175 watts. The efficacy of that lamp is about 80 lumens per watt.

The common belief among lamp designers has been that the efficacy in smaller sizes of metal halide discharge lamps drops so badly as to make them completely impractical for general lighting applications. Thus, small metal halide lamps which can be used, for example, for general lighting in a home in place of small incandescent of fluorescent lamps have not been commercially available.

SUMMARY OF THE INVENTION

The object of the invention is to provide new high pressure metal halide discharge lamps of small and intermediate sizes (i.e., 250 watts or less) and having higher efficacy than has been possible heretofore without compromising other performance factors.

We have discovered that an important factor in obtaining high efficacy in low and intermediate wattage metal halide discharge lamps resides in developing high temperatures at the ends of the lamp without excessively blocking the transmission of light at the lamp ends and without creating excessive thermal end losses. This is accomplished by utilizing small seals around the electrodes at the ends of the arc chamber and by proper choice of the size and shape of the chamber, particularly the aspect ratio of arc chamber length to diameter. In general, the arc chamber should have a relatively large cross-section and should be faired or smoothly contoured. Preferably, the arc chamber is generally ellipsoidal in shape and includes relatively smooth transitions from its center to its end portions in order to avoid excessive stresses and metal condensation in the transition regions. It is desirable to omit heat-conserving and light-obstructing coatings and the like at the ends of the chamber entirely.

Proper positioning of the electrodes within the end portions of the chamber also is important to obtain good efficacy, low color temperature and fast warm up. Proper positioning involves inserting the electrodes sufficiently far to prevent destructively high temperatures at the seals while avoiding such an excessive electrode insertion depth as to cause a detrimental drop in temperature behind the electrodes.

The foregoing design characteristics must be achieved while maintaining an arc loading sufficiently high to obtain good efficacy and while maintaining the wall loading of the lamp envelope in a range to assure reasonable lamp life with the material used for the envelope. Thin-walled fused silica envelopes are used in order to enable the end seals to be kept small and, with such envelopes, wall loadings between 10 and 35 watts per square centimeter of envelope surface are established.

DESCRIPTION OF DRAWINGS

FIG. 2 illustrates a 250 watt jacketed metal halide lamp embodying the preferred form of the invention.

FIG. 3 shows an unjacketed prior art 250 watt metal halide lamp for comparison with the lamp of FIG. 2.

FIG. 4 illustrates an unjacketed 70 watt metal halide lamp embodying the invention.

FIG. 5 shows an unjacketed 30 watt metal halide lamp embodying the invention.

FIG. 6 is a schematic view which illustrates the solid angles subtended by the seals at the ends of the lamp of FIG. 2 relative to the total solid angle surrounding the center of the lamp.

DETAILED DESCRIPTION

Figure 1A:
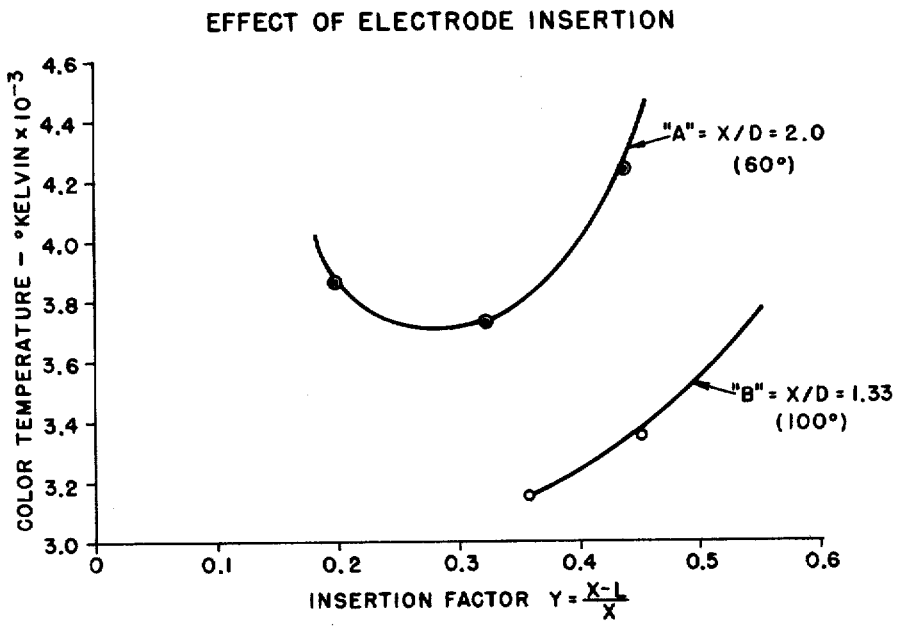
FIGS. 1*a* and 1*b* are graphs showing the effect of electrode insertion on color temperature and efficacy.

Metal halide discharge lamps which utilize fused silica envelopes for the arc tubes have been made conventionally buy a specific manufacturing process which is convenient and relatively inexpensive. The process most widely used involves making the arc chamber from a straight piece of fused silica quartz tubing, the ends of which are heated and collapsed into a flattened portion or pinch in which are embedded the inleads connecting the electrodes to the outside. We have concluded that prior design practice which has been coupled with lamps using such arc tubes has inevitably led to low efficacy in high pressure discharge lamps of small size and has fostered the belief that a small metal halide lamp of high efficacy could not be commercially produced.

Prior Design Practice

Conventional prior art practice in designing smaller sizes of high pressure metal halide lamps went about as follows. Assume a pre-existing satisfactory 500-watt design operating with an arc drop of about 135 volts from which a 250-watt design is to be derived by modification. In order to maintain good efficacy, the arc loading P, that is, the power input into the lamp (watts) divided by the arc length (centimeters), must be kept high. One may keep the same arc loading and at the same time halve the input from 500 watts to 250 watts by reducing the length of the arc to a half thereby halving the voltage across the lamp, assuming the same mercury density and current during steady state operation. Existing ballast design, however, requires that the voltage be maintained close to the design figure of 135 volts. By increasing the mercury dose, that is, by slightly more than doubling the operating mercury vapor density, the voltage drop across the modified lamp may be restored to its original value. However, now in order to halve the input, the current must be halved. But reducing the current reduces heat produced by ion and electron bombardment at the electrode tips and causes the electrodes to stay relatively cool. Accordingly, the wall temperature at the ends of the arc chamber (near where the electrodes pass through) is reduced and can result in condensation of a pool of mercury in the ends. Warm-up time, that is, the time required to build up the vapor pressure and reach normal light output after starting the lamp, will probably become excessive even though all the mercury is eventually vaporized. But even if slow warm up could be tolerated, the cooler steady-state end temperature forms a cold spot which lessens the steady state partial pressure of the halide vapor and leaves the lamp far from the desired color temperature of emitted light.

Compromise in Prior Designs

In order to resolve the problem of mercury and metal halide condensation in the ends and slow warm up, the prior art has resorted to various expedients. One expedient is to reduce the arc chamber diameter and thereby the surface area of the end portions so that the same electrode losses will produce higher end temperatures. However, such reduction in arc chamber diameter may increase the wall loading beyond permissible levels. To bring the wall loading down to acceptable levels, the lamp length must be increased but doing so increases the arc loading and reduces efficacy.

Another common and almost universal expedient has been to apply reflective, heat-conserving coatings to the ends of the arc tube in order to trap heat. For instance, it has been common practice to coat a white opaque layer of zirconia or alumina powder on the outer surface ends of metal halide arc tubes. By so reducing heat loss by radiation through the chamber walls at the end regions, adequate end temperature may be obtained with less need to reduce the chamber diameter and thereafter the arc loading. The efficacy achieved thus is better than it would be were the arc tube ends merely allowed to run cold at the same arc loading. In metal halide lamps in which metal halides are added to the mercury fill, end conditions are critical. While the vapor pressure of a metal halide is often higher than that of the constituent metal, the metal halides used in lamps generally have vapor pressures several orders of magnitude below that of mercury. Since the efficacy and color rendition of metal halide lamps is dependent upon achieving adequate vapor pressure of the metal halides, the design trend has been to heat-conserving end coatings of large area and to comparatively high wall loadings.

The immediate effect of more extensive end coatings and higher wall loadings in metal halide lamps is indeed to raise efficacy and improve color characteristics. End coatings, however, are inherently radiation-absorptive in character and are therefore bad from the standpoint of efficacy. That is, they trap radiant heat energy to keep temperatures up; but they also block radiant light energy. This drawback has been obscured by the fact that end coatings produce an immediate increase in light output due to the higher metal halide vapor density achieved.

In sum, while the performance of a given lamp may be improved by an end coating, the very presence of the coating indicates that the design is not optimized since a coating always blocks light and causes lumen loss. The larger or the more extensive the end coating, the greater is the departure from the optimum.

New Design Practice

Our invention optimizes metal halide lamp structure for efficacy and long life in intermediate and smaller lamp sizes, generally 250 watts or below, by the following features:

(1) A wall loading in the range of 10 to 35 watts/cm$^2$ so that, with the thin-walled fused silica used for the lamp envelope, the lamp possesses adequate life and lumen maintenance.

(2) Short arc length and small arc chamber size appropriate to obtain the arc loading necessary for high efficacy. The arc loading should be as high as possible within the range of 60 to 150 watts/cm but should not be so high as to cause the upper limit on wall loading to be exceeded.

(3) Arc chamber proportions characterized by an aspect ratio (X/D) of internal length (X) to major diameter (D) falling in the range of approximately 0.9 to 2.5, and as large as possible within such range commensurate with the limitation on wall loading.

(4) Inlead seals which subtend no more than a small percentage of the total solid angle at the center of the envelope and which are small relative to the size of the envelope in order to minimize thermal end losses by construction and radiation. Heat-conserving devices or coatings on the ends of the lamp are preferably eliminated altogether but when used as a compromise measure, the solid angle subtended collectively by the seals and such devices or end coatings should be less than 10% of the total solid angle at the center of the arc chamber.

(5) Arc chamber end portions curved to a radius not exceeding the radius at midsection and preferably less (except when X/D is less than (1), the arc chamber having a faired configuration leading smoothly into the end portions and preferably being generally ellipsoidal.

(6) Electrode insertion depths sufficient to avoid excessive seal temperatures but not so great as to create cold temperature wells behind the electrodes. With the present lamps, electrode insertion factors falling in the range of 0.1 to 0.6 are utilized.

Wall Loading

Wall loading is established by the input watts into the lamp divided by the external radiating surface area of the arc chamber. In practice the radiating surface is taken as the external surface of the envelope excluding the neck seals. The permissible wall loading depends upon the envelope material used and the lamp life and lumen maintenance considered adequate for the intended use of the lamp. With quartz or fused silica, excessive wall loading causes envelope devitrification to set in earlier and results in poor maintenance and shortened lamp life. Thin-walled quartz envelopes are preferred in the present lamps because the use of thin-walled quartz permits the end seals to be of small cross-sectional area. A thin-walled envelope is one so thin that it will either expand or collapse should the inside surface be heated to plasticity during lamp operation. Any wall thickness of 1.5 millimeters or less is considered thin-walled. With the thin-walled envelopes of fused silica used in our metal halide lamps, we establish wall loadings in the range of 10 to 35 watts/cm$^2$ in order to have adequate lumen maintenance and lamp life for general lighting applications.

Arc Length and Arc Loading

For a given power input, a short arc length means a high arc loading, that is, a high power input per unit length of arc and this is desirable. But for a given electrode insertion depth, a short arc length requires a short arc chamber and, in general, small arc chamber size and high wall loading. Since excessive wall loading must be avoided, it follows that the arc loading should be not increased beyond the point of real utility.

At low arc loadings, efficacy increases rapidly with an increase in loading but, at higher arc loadings, the rate of increase tapers off. We have found that at arc loadings beyond 150 watts/cm for metal halide lamps, the problems of devitrification of the fused silica envelope and poor lumen maintenance outweigh any further benefits in efficacy unless the arc chamber diameter is made considerably greater than the arc chamber length. But a diameter much greater than the length introduces difficulties in vaporizing the dose and establishing high operating pressures. For these reasons and in keeping with the invention, we limit the arc loading to the range of approximately 60 to 150 watts per centimeter.

Arc Chamber Proportions

The volume of the arc chamber should be small in order to establish a short arc length and a high mercury vapor density for a given dose or mass of mercury. Our 250 watt metal halide lamp utilizes an arc chamber with a volume of about 4 cc while the arc chambers of our smaller lamps are less than 1 cc in volume.

While the need for a high arc loading limits the arc length L which, in turn, tends to limit the length of the arc chamber, the combination of such need with the above-described restriction on wall loading has enabled us to specify successful arc chamber shapes in a limited range of proportions. The arc length L plus the insertion depth of the two electrodes gives the internal arc chamber length X. The internal diameter D of the arc chamber is the mean diameter at the maximum transverse cross section of the chamber.

Considering the aspect ratio of the internal arc chamber length X to the internal diameter D, we have determined that X/D should be between 0.9 and 2.5. Within this range, it is preferred to utilize the highest X/D ratio consistent with the limitations which life and maintenance requirements impose upon wall loading. Arc chamber proportions in the range of 0.9 to 2.5 are a departure from those of prior conventional metal halide lamps for general lighting applications in which the aspect ratio X/D is generally above 2.5. Our arc chamber tends away from the elongated cylinder which has been favored up to now, and moves toward an ellipsoidal shape or a close approximation thereof. In the lowest wattages, the chamber may tend toward a spherical or approximately spherical shape and may even go beyond a sphere to a slightly oblate spheroid. There is, however, little advantage in going beyond a sphere since difficulties with dose vaporization may arise. Also, even a sphere has some disadvantage when compared to an ellipsoid since there is a more abrupt change in the inner wall of a sphere at the neck seals and thus a sphere is more likely to rupture.

Ellipsoidal and spheroidal arc chambers have heretofore been used mostly in very high wattage lamps having inputs of 1,000 watts or more, and in so-called compact lamps used for special short-life applications such as projection and photocopying. Those compact lamps are designed to produce small light sources of extremely high brightness and they use high arc loadings well in excess of 150 watts/cm and very high wall loadings well above 100 watts/cm$^2$. They require thick-walled envelopes in order to withstand the tremendous internal pressures and they have relatively low efficacy and short lives. By contrast, lamps according to the invention used thin-walled envelopes and have high efficacy and long lives.

Small Inlead Seals

The inleads which support the electrodes extend through seals, that is, through relatively long fused silica necks which do not transmit light effectively. We have found that the seals cause a lumen loss in substantially the same way as do end coatings and that the loss is proportional to the radiation blocking cross section of the seals. The radiation blocking or absorptive cross section at the lamp ends may be measured as the percentage collectively subtended by the two seals, or by the seals and end coats, of the solid angle at the center of the arc chamber. Alternatively, the absorptive cross section may be defined in an equivalent way as the percentage of the surface of an imaginary sphere surrounding the lamp which would be shadowed by the end seals when a point source of light is placed at the center of the arc chamber (see FIG. 6). In some prior art lamps which use full diameter pinch seals, the radiation absorptive cross section of the seals alone might exceed 10%, and the collective radiation absorptive cross section of seals and end coats might exceed 20%. According to our invention, the absorptive cross section of the neck seals should be made as small as possible within acceptable manufacturing practice, preferably less than 1% in the larger lamps coming within the scope of the invention. In any event the collective absorptive cross section of the neck seals and end coats should be less than 10% of the solid angle at the center of the arc chamber. As the envelope size is reduced, the practical difficulties of handling very small parts means that a higher absorptive cross section must be accepted.

An additional important benefit that results from the use of small neck seals is that thermal losses through the seals by way of conduction and radiation are reduced. Seals of large cross section tend to act as cold sinks and draw heat from the ends of the arc chamber. By utilizing small seals (made possible in part by thin-walled quartz), the surface area and thus the heat radiating capacity of the seals are reduced. This helps keep the ends of the chamber at a high temperature to avoid metal condensation and to promote fast warm up without the need of end coatings.

End Chambers and Fairing

The end portions of the envelope may be defined as the portions of the envelope volume which lie beyond imaginary planes passing through the electrode tips and normal to the lamp axis. In other words, the end portions are the portions between these planes and the entry points of the inleads.

In general, the ends should be formed to a curvature not less than the curvature of the arc chamber wall at midsection except in the case of an X/D ratio of less than 1, in which case the curvature at the ends may be less than at midsection by as much as 10%. The end portions should be rounded and free of recesses or creases which would form cool spots in which metal vapor would condense. The envelope configuration should be faired, that is, there must be relatively smooth transition portions from the midsection to the end portions. Preferably, there should be a smooth curve merging approximately tangentially into the curve at midsection and into the curve of the end portions and necks. The shape must be such as to avoid excessive metal condensation in the transition regions and, if there is any condensation, it should be uniformly distributed. In general, sharp angles or abrupt reversals in curvature are to be avoided. Ultimately, the suitability of the chamber configuration is determined by its ability to develop a high efficacy and produce the lamp color temperature desired without requiring the addition of end coatings.

Electrode Insertion

In a metal halide lamp, the metal halide fill constituents never fully vaporize. The final location and temperature of the condensate which remains in the chosen end portion shape are critically dependent on electrode insertion factor Y may be defined as the ratio of the sum of the insertion depths for both electrodes to the arc chamber length X. It may be defined equivalently as the ratio of the diference between arc chamber length X and arc length L, to arc chamber length, and is given by the following equation:

$$Y=(X-L)/X$$

For horizontal lamp operation, equal electrode insertion at both ends is desirable. But in vertical operation where the temperature conditions at the two ends may be quite different due to gravitational and convective effects, an asymmetrical pattern is often preferable.

Figure 1B:
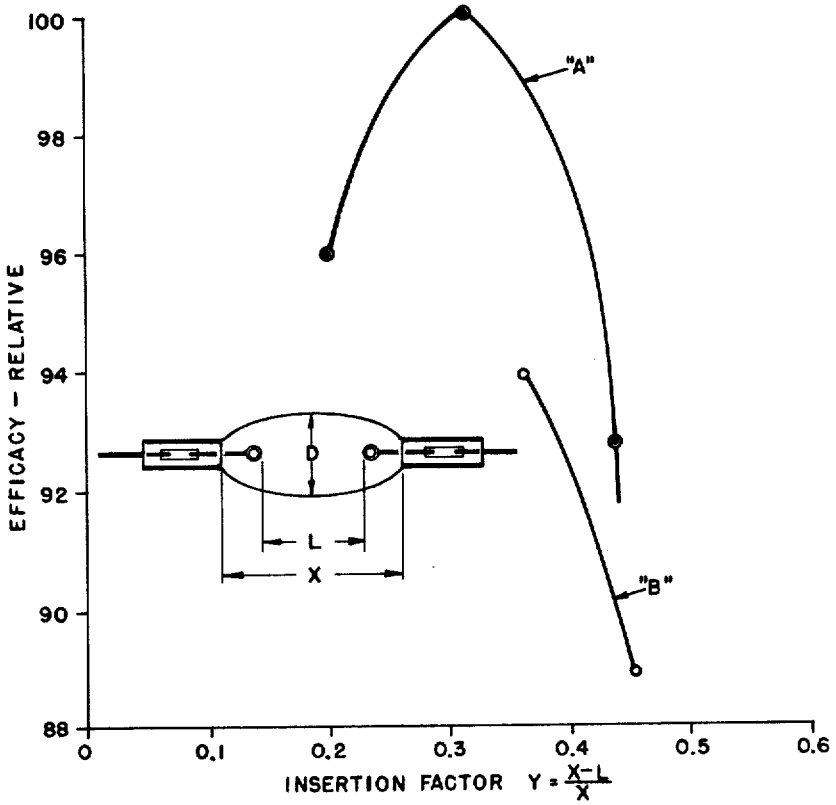

The variation in color temperature and relative efficacy as a function of the electrode insertion factor Y is shown for 250 watt lamps in FIGS. 1*a* and 1*b*. The dimensions X, D and L are shown in the inset view of a typical new 250 watt lamp in FIG. 1*b*. The curves denoted A in the two figures correspond to a lamp having an X/D ratio of 2.0 and wherein tangent lines to the durving side walls intersect at the axis and make an angle of about 60°. The curves labeled B correspond to a lamp having an X/D ratio of 1.3 wherein the tangent lines similarly intersect at an angle of about 100°. Looking first at case "A", it is seen that for a relatively great insertion depth corresponding to an insertion factor Y greater than 0.4, the color temperature (FIG. 1*a*) is high and the efficacy (FIG. 1*b*) is low. Under this condition, the metal halide condensate from the charge is collected mostly behind the electrodes. For lesser electrode insertion depths, the color temperature falls and the efficacy increases until substantially all the condensate is driven out of the end portion into the arc portion or main body of the envelope, the condensate creating a film or layer on the inner surface of the chamber. The optimal condition for this lamp is an insertion factor Y of approximately 0.31 for which the color temperature curve reaches its nadir while the efficacy curve reaches its zenith. If the electrode insertion depth is reduced further, however, the condensate starts to approach the seals again. When this happens, the condensate is at a lower temperature because the arc loading has been reduced and also because the condensate in its new location is not as effectively heated by the arc. Thus, efficacy falls and the color temperature begins to rise again.

Where the envelope walls diverge rapidly from the axis as a function of distance from the electrode entry point, variation of electrode insertion depth will have a lesser effect on condensate distribution than where the walls diverge more slowly from the axis. Rapid divergence occurs with an X/D ratio approaching unity, while a large X/D ratio means slow divergence. In the case of too rapid divergence, the electrode tips, with insertion depth for maximum efficacy, may be so close to the end seals that the maximum temperature for long term integrity of the seals and end walls of the fused silica envelope is exceeded. Case "B" illustrates such condition wherein efficacy continues to increase in FIG. 1*b* as the electrode insertion depth is reduced. At a factor Y of 0.35, the electrode insertion depth is so small that the critical seal temperature was exceeded and early devitrification was experienced. Thus, case "B" represents a non-optimized lamp structure whose performance would be improved by an end coating. The overall efficacy in case "B", however, will always fall considerably short of that in case "A" wherein a higher X/D ratio was chosen. These results illustrate the desirability of choosing the highest X/D ratio possible consistent with the need not to exceed the permissible wall loading.

From the above-described tests and measurements and from others of a similar nature, we have concluded that the electrode insertion factor Y should be in the range of 0.1 to 0.6. For the lamps considered in FIGS. 1*a* and 1*b*, the lowest color temperature and the highest efficacy occur near the midpoint of this range, from about 0.2 to 0.4, but the particular choice for any given lamp design will depend pon the end configuration and the wattage chosen.

SPECIFIC EMBODIMENTS

FIG. 2 illustrates a 250 watt metal halide lamp embodying the invention in which the foregoing design principles have been utilized. The lamp comprises an arc chamber defined within an inner envelope 1 of thin-walled fused silica supported within an outer glass envelope or jacket 2. A suitable filling for the inner envelope 1 comprises 28 mg of mercury and 50 mg of halide salt consisting of 84% NaI, 12% $ScI_3$ and 4% $ThI_4$ by weight plus an inert starting gas such as argon or xenon. The inner envelope has an internal volume of 3.9 cc.

The outer jacket 2 is provided at its lower end with a re-entrant stem 3 through which extend relatively stiff lead-in wires, 4,5 connected at their outer ends to the electrical contacts of a conventional screw base, namely, the threaded shell 6 and the end contact 7. The inner envelope 1, commonly called the arc tube even though it is shaped like an ellipsoid and not like a tube, is suspended within the jacket between long side rod 8 and short support rod 9 which are welded to lead-in wires 4,5. The space within the outer jacket is filled to 0.5 atmosphere of nitrogen but may be evacuated if desired in order to reduce the heat loss from the arc tube.

The inner envelope or arc tube 1 is made of thin-walled (i.e., less than 1.5 millimeter) quartz or fused silica and the discharge space or arc chamber is substantially ellipsoidal. It may be considered as having been generated by revolving an ellipse about the longitudinal axis of the lamp which appears vertical in FIG. 2. One way of forming the bulb portion 11 is by the expansion and upset of relatively thin-walled fused silica tubing while heated to plasticity and revolving in a double chuck glass lathe. The neck portions 12, 13 may be formed in similar fashion by allowing the quartz tubing to neck down through surface tension. In general, the wall thickness and the bulb shape may be controlled by coordinating the rate and place of heating and the rate of expansion or necking down. Another process for forming a bulb of this general shape is disclosed in Szilagyi U.S. Pat. No. 3,897,233. Alternatively, the arc chamber may be made by heating and blow-molding into the desired shape an open-ended fused silica tube of appropriate wall thickness.

Tungsten wire electrodes 14, 15 having their distal ends formed into open loops as illustrated are preferred. The electrodes 14, 15 are mounted in opposite ends of the arc tube and extend from inleads comprising intermediate molybdenum foils 16, 17 which, in turn, are connected by outer inlead portions 18, 19 to side rod 8 and support rod 9, respectively. The hermetic seals are made at the molybdenum foils 16 which are wetted by the silica being heated to plasticity during the sealing operation. At such time, the fused silica may be pressed against the foils by the application of vacuum, by mechanical pinching or by both. The filling or charge is introduced into the envelope through a side exhaust tube which is then tipped off at 21.

The neck portions or end seals 12, 13 illustrated have been vacuum-formed and are cylindrical as shown in FIG. 6. In carrying out the invention, the seals 12, 13 are formed with a small cross-sectional area so as to reduce the light radiation blocking or absorptive cross section at the lamp ends and to minimize heat losses through the seals. With the envelope 1 of the 250 watt lamp shown in FIGS. 1 and 6, the solid angle a subtended by each end seal 12, 13 is about 0.3 percent of the solid angle at the center of the envelope 1. In other words, the end seals 12, 13 are of such cross-sectional area that the total area of shadows 25 (FIG. 6) cast by the end seals on the surface of an imaginary sphere 26 surrounding the lamp would be only about 0.6 percent of the total surface area of the sphere if a point light source were placed at the center 27 of the envelope. In this embodiment, the seals 12, 13 and the ends of the envelope 1 are entirely free of heat-conserving coatings. Thus, the only light masking which occurs at the ends of the envelope is the masking which results from the end seals.

A better appreciation of the invention may be gained by comparing our new 250 watt metal halide lamp with a conventional prior art lamp of the same rating and using the same filling, the prior art lamp being illustrated at 51 in FIG. 3. That lamp is made from a generally cylindrical fused silica tube whose ends are closed by large, full diameter pinch seals 52. The main electrodes 53 comprise double layers of tungsten wire wound around tungsten shanks, the coils and the spaces between the coils being coated or filled with emissive oxides including alkaline earth metal oxide. A bare length of tungsten wire 54 projects into the arc chamber and defines a starting electrode. The ends of the arc tube are conically rounded and are coated with opaque white zirconium oxide layers at 55 and 56. Coating 55 is lowermost in operation and is larger in area than coating 56. The coated ends altogether subtend about 10% of the total solid angle surrounding the center of the arc tube.

More particularly, the lamps of FIGS. 2 and 3 are compared by the data in the following table:

TABLE 1

250 W. METAL HALIDE LAMP COMPARISON

| | 250 W Prior Art | 250 W New Design |
|---|---|---|
| Arc Loading | 68.5 w/cm | 115 w/cm |
| Arc Length (L) | 3.7 cm | 2.2 cm |
| Arc Chamber Length (X) | 4.6 cm | 3.0 cm |
| Diameter (D) | 1.5 cm | 1.5 cm |
| L/D | 2.4 | 1.5 |
| X/D | 3.0 | 2.0 |
| Insertion Factor (Y) | 0.20 | 0.27 |
| External Radiating Area | 22.0 $cm^2$ | 14.8 $cm^2$ |
| Volume | 6.8 $cm^3$ | 3.9 $cm^3$ |
| Wall Loading | 11.4 $w/cm^2$ | 17.0 $cm^2$ |
| Solid Angle Subtended | 10% | 0.6% |
| Efficacy | 82 LPW | 105 LPW |
| Lumens | 20,500 | 26,300 |
| Hg Loading | 31 mg | 28 mg |
| Hg Density | 4.6 $mg/cm^3$ | 7.2 $mg/cm^3$ |

Table 1 above shows the advantages gained by applying our invention in a 250 watt metal halide lamp. The lamp embodying the invention has an efficacy of 105 lumens per watt by contrast with 82 l.p.w. in the prior art lamp. Besides the improvement in efficacy, our design shows an improvement in lumen maintenance.

A 70 watt size metal halide lamp embodying our invention is shown at 61 in FIG. 4. The arc chamber is generally ellipsoidal and the fill comprises mercury, NaI, $ScI_3$, $ThI_4$ and argon. Tungsten wire electrodes 62 are sealed into the envelope through narrow necks 63. The electrodes are connected to inleads 64 which include foliated portions 65 hermetically sealed in the necks. The arc chamber is purged and the dose is introduced through one of the necks prior to sealing so that no lateral exhaust tip remains. There is no auxiliary starting electrode and there is no heat-reflecting coating.

By appropriately scaling the lamp of FIG. 4 to reduce its size, a 30 watt metal halide lamp with an ellipsoidal arc chamber may be provided. Physical details and parameters for 70 and 30 watt lamps with ellipsoidal arc chambers are given in Table 2 below.

TABLE 2

MINIATURE ELLIPSOIDAL LAMP 3,450

| | 70W | 30W |
|---|---|---|
| Arc Loading | 78 w/cm | 67 w/cm |
| Arc Length (L) | 0.9 cm | 0.45 cm |
| Arc Chamber Length (X) | 1.3 cm | 0.75 cm |
| Diameter (D) | 0.7 cm | 0.35 cm |
| L/D | 1.3 | 1.3 |
| X/D | 1.9 | 2.1 |
| Insertion Factor (Y) | 0.31 | 0.47 |
| External Radiating Area | 3.9 $cm^2$ | 1.2 $cm^2$ |
| Volume | 0.33 $cm^3$ | 0.066 $cm^3$ |
| Wall Loading | 18 $w/cm^2$ | 25 $w/cm^2$ |
| Solid Angle | 2.4% | 5.6% |
| Efficacy | 100 LPW | 106 LPW |
| Lumens | 7,000 | 3,480 |
| Hg Loading | 11.6 mg | 2.5 mg |

TABLE 2-continued

| MINIATURE ELLIPSOIDAL LAMP 3,450 | | |
|---|---|---|
| | 70W | 30W |
| Hg Density | 35.2 mg/cm$^3$ | 39.8 mg/cm$^3$ |

Table 2 does not include a comparision with prior art metal halide lamps of comparable size or rating because, to the best of applicants' knowledge, heretofore none existed. The efficacies of both small lamps embodying the invention are not only high in absolute terms but are truly astonishing for their size. That of the 70 watt lamp at 100 l.p.w. tops the prior art 250 watt metal halide lamp of Table 1 at 82 l.p.w. That of the 30 watt lamp at 106 l.p.w. significantly exceeds the efficacy of about 80 l.p.w. of a prior art 175 watt metal halide lamp using the same kind of fill. Efficacies of this kind in metal halide discharge lamps under 100 watts in size were previously considered impossible.

Another miniature metal halide lamp embodying our invention, again a 30 watt size, is shown at 76 in FIG. 5 and comprises a spherical arc chamber. The same kind of fill may be used as in the lamp of FIG. 4. The electrodes 77 are tungsten wire portions connected to the inleads 78 having foliated portions 79 in narrow necks 80. Other physical details and parameters for this lamp are given in Table 3 below.

TABLE 3

| MINIATURE SPHERICAL LAMP PARAMETERS | |
|---|---|
| | 30 W |
| Arc Loading | 100 w/cm |
| Arc Length (L) | 0.3 cm |
| Arc Chamber Length (X) | 0.6 cm |
| Diameter (D) | 0.6 cm |
| L/D | 0.5 |
| X/D | 1.0 |
| Insertion Factor (Y) | 0.5 |
| External Radiating Area | 1.4 cm$^2$ |
| Volume | 0.11 cm$^3$ |
| Wall Loading | 21 w/cm$^2$ |
| Solid Angle | 6% |
| Efficacy | 85 LPW |
| Lumens | 2,550 |
| Hg Loading | 4.3 mg |
| Hg Density | 39.1 mg/cm$^3$ |

An optimized lamp design in accordance with our invention utilizes the smallest practical end seals possible, and selects the arc chamber aspect ratio and the other parameters which have been discussed to achieve the desired operating conditions without resorting to heat-conserving devices or coatings on the ends of the lamp. However it may happen in practice that it is more economical to keep an existing lamp envelope design and effect a desired change in performance, such as lowering the color temperature, by resorting to end costs of minor extent. This may be illustrated by the following example. Consider a lamp of 35 watt size with an ellipsoidal envelope having an X/D ratio of about 2 as illustrated in FIG. 4. This lamp has an efficacy of 115 lumens per watt at a color temperature of 4500° K., and its end seals together subtend about 5% of the solid angle at the center of the arc chamber. Assume now that it is desired to produce a similar lamp with a color temperature lowered to about 3800° K. This may be done by putting reflective end coats about the seals that would increase the percentage of the solid angle collectively subtended by the seals and end coats to about 10%. The resulting hotter lamp ends drive the excess halide salt further away from the ends towards the central part of the arc chamber. This may lower the color temperature about 700° K. and at the same time cause a drop in efficacy of about 20%. Thus a new lamp product is made possible having the desired color temperature at an efficacy of 92 lumens per watt. The lamp may be entirely adequate for the prospective market and the expense of equipment redesign including new molds for a modified envelope configuration are avoided.

In prior art metal halide lamps using fused silica envelopes, wall loading has generally not exceeded about 15 watts/cm$^2$. This was higher than the 10 watts/cm$^2$ ceiling generally accepted for mercury lamps (i.e., a lamp having a fill of mercury with no metal halide additive). The higher wall loading, however, was deemed necessary in order to generate sufficient vapor pressure of the added metal halide salts and to realize appreciable benefits from their presence. The life of metal halide lamps is considerably limited by sodium loss and/or increasing arc voltage drop as a function of operating time. It was generally accepted that their lumen maintenance and life were inherently inferior to those of mercury lamps.

An unexpected benefit realized by our invention is that wall loadings well beyond 15 watts/cm$^2$ can be used in metal halide lamps without adverse effects. The lumen maintenance and life of our lamps are superior to those of conventional lamps using the same halide species. In fact, we find that wall loadings up to 35 watts/cm$^2$ can be used without incurring drastic penalties in maintenance while holding sodium loss and/or arc voltage rise down to tolerable levels. The practical limitation on wall loading now becomes the softening point of the quartz or fused silica such that the arc chamber no longer retains its initial shape under the stress of the internal pressure, and that limitation depends upon wall thickness. However, virtually all the desired results can be readily obtained with thin-walled fused silica envelopes at loadings less than 35 watts/cm$^2$, thereby making possible designs having inherently higher efficacy while retaining the advantages of thin-walled fused silica.

What we claim as new and desire to secure by United States Letters Patent is:

1. A high pressure metal vapor arc discharge lamp for general illuminating purposes and rated for a power input of not more than 250 watts, said lamp comprising an arc chamber having a shape selected from the group of shapes consisting essentially of ellipsoids and spheroids and approximations thereof, said arc chamber being defined within an envelope made of light-transmitting material and having a wall thickness not exceeding 1.5 millimeters, a fill of mercury and metal halide contained within said chamber and adapted to be vaporized during operation of the lamp, said arc chamber having a wall area of such value as to effect a wall loading in the range of from about 10 to 35 watts/cm$^2$ when the lamp is operated at rated wattage, said arc chamber having a length-to-diameter ratio (X/D) in the range of from about 0.9 to 2.5, a pair of electrodes supported within said arc chamber on inleads extending through said envelope, said electrodes having opposing tips spaced from one another by a distance L of such value as to effect an arc loading in the range of from about 60 to 150 watts/cm when the lamp is operated at rated wattage, the insertion factor Y of said electrodes being in the range of from about 0.1 to 0.6, where Y is equal to the quantity (X−L)/X, and neck seals hermetically bonding said inleads to said envelope, said neck seals and any heat-conserving devices associated therewith collectively subtending less than 10 percent of the solid angle at the center of said arc chamber.

2. A lamp as defined in claim 1 and rated for a power input of about 250 watts, said arc chamber having a generally ellipsoidal shape, the wall loading being in the range of from about 10 to 25 watts/cm$^2$, the (X/D) ratio being in the range of from about 1.5 to 2.5, the arc loading being in the range of from about 100 to 150 watts/cm, said neck seals and any heat-conserving devices associated therewith collectively subtending less than 1 percent of the solid angle at the center of the arc chamber.

3. A lamp as defined in claim 1 and rated for a power input of not more than 70 watts, said arc chamber having a volume of less than 1 cubic centimeter, the wall loading being in the range of from about 15 to 35 watts/cm$^2$, the arc loading being in the range of from about 60 to 120 watts/cm, said neck seals and any heat-conserving devices associated therewith collectively subtending less than 7 percent of the solid angle at the center of the arc chamber.

4. A high pressure metal vapor arc discharge lamp for general illuminating purposes and rated for a power input of not more than 250 watts, said lamp comprising an arc chamber having a shape selected from the group of shapes consisting essentially of ellipsoids and spheroids and approximations thereof, said arc chamber being defined within an envelope made of light-transmitting material and having a wall thickness not exceeding 1.5 millimeters, a fill of mercury and metal halide contained within said chamber and adapted to be vaporized during operation of the lamp, said arc chamber having a wall area of such value as to effect a wall loading in the range of from about 10 to 35 watts/cm$^2$ when the lamp is operated at rated wattage, said arc chamber having a length-to-diameter ratio (X/D) in the range of from about 0.9 to 2.5, the entire internal and external surfaces of said envelope being free of heat-conserving coatings, a pair of electrodes supported within said arc chamber on inleads extending through said envelope, said electrodes having opposing tips spaced from one another by a distance L of such value as to effect an arc loading in the range of from about 60 to 150 watts/cm when the lamp is operated at rated wattage, the insertion factor Y of said electrodes being in the range of from about 0.1 to 0.6, where Y is equal to the quantity (X−L/X), and neck seals hermetically bonding said inleads to said envelope and subtending less than 10 percent of the solid angle at the center of said arc chamber.

5. A high pressure metal vapor arc discharge lamp for general illuminating purposes and rated for a power input of not more than 70 watts, said lamp comprising an arc chamber having a shape selected from the group of shapes consisting essentially of ellipsoids and spheroids and approximations thereof, said arc chamber having a volume of less than one cubic centimeter and being defined within an envelope made of light-transmitting material and having a wall thickness not exceeding 1.5 millimeters, a fill of mercury and metal halide contained within said chamber and adapted to be vaporized during operation of the lamp, said arc chamber having a wall area of such value as to effect a wall loading in the range of from about 15 to 35 watts/cm$^2$ when the lamp is operated at rated wattage, said arc chamber having a length-to-diameter ratio (X/D) in the range of from about 0.9 to 2.5, the entire internal and external surfaces of said envelope being free of heat-conserving coatings, a pair of electrodes supported within said arc chamber on inleads extending through said envelope, said electrodes having opposing tips spaced from one another by a distance L of such value as to effect an arc loading in the range of from about 60 to 120 watts/cm when the lamp is operated at rated wattage, the insertion factor Y of said electrodes being in the range of from about 0.1 to 0.6, where Y is equal to the quantity (X−L/X), and neck seals hermetically bonding said inleads to said envelope and subtending less than 7 percent of the total solid angle surrounding the center of said arc chamber.

6. A high pressure metal vapor arc discharge lamp for general illuminating purposes and rated for a power input of not more than 70 watts, said lamp comprising an arc chamber having a substantially ellipsoidal shape and having a volume of less than one cubic centimeter, said arc chamber being defined within an envelope made of fused silica and having a wall thickness not exceeding 1.5 millimeters, a fill of mercury and metal halide contained within said chamber and adapted to be vaporized during operation of the lamp, said arc chamber having a wall area of such value as to effect a wall loading in the range of from about 15 to 35 watts/cm$^2$ when the lamp is operated at rated wattage, said arc chamber having a length-to-diameter ratio (X/D) in the range of from about 1.5 to 2.5, the entire internal and external surfaces of said envelope being free of heat-conserving coatings, a pair of electrodes supported within said arc chamber on inleads extending through said envelope, said electrodes having opposing tips spaced from one another by a distance L of such value as to effect an arc loading in the range of from about 60 to 120 watts/cm when the lamp is operated at rated wattage, the insertion factor Y of said electrodes being in the range of from about 0.1 to 0.6, where Y is equal to the quantity (X−L/X), and neck seals hermetically bonding said inleads to said envelope and subtending less than 7 percent of the solid angle at the center of said arc chamber.

* * * * *